US006006673A

United States Patent [19]

Brandt

[11] Patent Number: 6,006,673

[45] Date of Patent: Dec. 28, 1999

[54] CYLINDER TYPE RAIL CAR INDEXER

[75] Inventor: Calvin J. Brandt, Delano, Minn.

[73] Assignee: Motion Controls, Inc., Delano, Minn.

[21] Appl. No.: 09/069,506

[22] Filed: Apr. 29, 1998

[51] Int. Cl.[6] ..... B61B 13/00

[52] U.S. Cl. ..... 104/162

[58] Field of Search ..... 104/165, 162; 198/736, 738, 746

[56] References Cited

U.S. PATENT DOCUMENTS

| | | | |
|---|---|---|---|
| 3,146,728 | 9/1964 | Doorley | 104/162 |
| 3,377,961 | 4/1968 | Hunt | 104/162 |
| 3,696,754 | 10/1972 | Anderson et al. . | |
| 4,006,691 | 2/1977 | Kacir et al. . | |
| 4,252,064 | 2/1981 | Ratchliff, Jr. et al. . | |
| 4,354,792 | 10/1982 | Cornish . | |
| 4,926,755 | 5/1990 | Seiford, Sr. . | |
| 5,287,812 | 2/1994 | Lobb et al. | 104/162 |
| 5,709,153 | 1/1998 | Brandt . | |

*Primary Examiner*—Mark T. Le
*Attorney, Agent, or Firm*—Nikolai, Mersereau & Dietz, P.A.

[57] ABSTRACT

A rail car indexer that provides a continuous transfer of the rail car bogeys from one dog to the next without ramming into the rail car axles in either the forward or rearward directions. The rail car indexer includes two parallel linearly offset progressor each of which has a barney and dog attached thereto. A center balance and back pressure bypass valve are used to control the raising of the dogs and to insure that the dogs remain in their lowered position until the proper progressor is ready to begin pulling on the rail car bogey axle. Sensors and a photo eye emitter and receiver coordinate the extension, retraction and transfer of an axle between the progressors.

12 Claims, 8 Drawing Sheets

CYLINDER TYPE RAIL CAR INDEXER

BACKGROUND OF THE INVENTION

I. Field of the Invention

The present invention relates generally to railway car handling equipment and, more particularly, to a rail car spotting or indexing system which positions railroad cars along a specified section of track to be addressed during loading or unloading operations. Specifically, the invention deals with an improved cylinder-type, axle progressing system having dual coordinated progressors of variable-stroke and speed, wherein the position of each dog of each progressor is automatically controlled.

II. Discussion of the Related Art

Freight hauling railway cars are positioned near freight or cargo handling equipment during loading and unloading operations. Freight in the form of bulk cargo such as grain, coal, iron or the like is typically lifted or dumped into railway cars. Subsequently, the freight is emptied from the cars by gravity and received by stationary freight handling equipment such as chutes and conveyor equipment. Liquid bulk cargo is typically unloaded by opening drain valves connected to large hoses and associated pumping equipment. A railway car used for transporting coal, grain, or other finely divided dry bulk agriculture material is typically covered and has a plurality of spaced bottom discharge hopper bins or chutes accessing the main storage volume and closed by discharge gates. This type of rail car is designed to be positioned over dedicated recessed receiving facilities situated at fixed stations, such as grain or coal bins and conveyors positioned beneath the railroad track.

During the unloading operation of a coupled string of rail cars, a connected train engine roughly positions one end of the string of cars near the unloading area. Train engines are not well suited for indexing or precisely positioning individual cars or even sets of cars along the railroad track, let alone over individual car bins, chutes or conveyors. To this end, positioning devices known as railway car indexers or spotters have been built and operated at fixed stations.

Railway car indexers include at least one engaging member or "dog" for engaging at least one railway car in a string of cars and pushing or pulling the string a given distance along the railroad track. The engaging member is often situated and operated along an auxiliary indexer track or guideway juxtaposed in parallel relation to the railroad track in the fixed receiving facility. Fluid-operated actuators, such as chains and sprockets driven by hydraulic or electrical motors supply power are provided for moving the railway cars. The dogs of these devices typically operate against the lower or upper portion of the railroad car wheel truck frame (bogey frame). One such device is illustrated and described in co-pending application Ser. No. 08/580,810, filed Dec. 29, 1995, now U.S. Pat. No. 5,709,153, issued Jan. 20, 1998, and entitled "HIGH DOG INDEXER". That application is common of inventorship and assignee with the present application.

U.S. Pat. No. 4,006,691 issued to Kacir et al. and U.S. Pat. No. 4,354,792 issued to Cornish show train positioners including an engaging member arm which engages a car coupler from above. The engaging member arm is situated on a track or guideway next to the railroad track. Power is supplied to the positioner for moving the railway cars by a motor connected to a pulley and cable assembly. These positioners are quite large and complex, and initially aligning the railway cars with the engaging member arm such that the arm may be lowered to engage the car coupler may be difficult.

U.S. Pat. No. 3,696,754, issued to Anderson et al, describes a railroad car shifting system mounted between the tracks which employs axle engaging dogs pivotally attached to dog carriages or barneys which are situated in a guideway. Each dog is spring-biased to a raised position for engaging and pushing the next railroad wheel axle encountered as the barney is moved in one direction along the guideway by a hydraulic cylinder. Each dog in the '754 patent pivots to a lowered position when pushed or hit from behind (as on a return stroke), but must be manually depressed to allow a reversal of the direction of the string or trip of cars. The system includes a variable-stroke hand-off system having a pair of telescoping, single acting hydraulic actuators situated in a partially overlapping parallel arrangement. In the stowed position the piston of at least one of the actuators is exposed. The actuators are linked by a common cable and sheave arrangement in which the extension of one actuator in a power stroke pulls on the cable which, in turn, causes the collapse or retraction of the other. In operation, the dogs alternately engage the axles of the successive carriages in cars using a variable stroke operation. A long vane and lever arm are used to control the stroke of each actuator. Apparently, each actuator extends past a respective bogey axle and then the actuator reverses direction, forcing the dog into the axle. The distance that the actuator extends past the forward edge of the vane must be greater than the distance between the axles of each bogey. It is not apparent from the Anderson disclosure that the wheel axle smoothly transfers from one dog to the other.

A later patent (U.S. Pat. No. 4,252,064 to Ratcliffe, Jr.) discloses dogs that pivot to a lowered position when pushed or hit from behind (as on a return stroke), and may be lowered with an auxiliary hydraulic cylinder-operated mechanism when reversing the direction of travel of the cars.

U.S. Pat. No. 4,926,755, issued to Seiford, Sr., describes a reversing railway car moving system including a double truck assembly which operates in a guide track alongside the railroad track. Each truck of the double truck assembly includes two engaging members which are hinged together and spring biased to a raised position to form a peak at the hinge. In the raised position, the two trucks form a valley in which the bogey wheel truck frame is engaged on the lower portion for movement in either direction. A hydraulic cylinder in each truck is extended to lower the engaging members such that a railway car may freely pass over the double truck assembly. This reversing railway car moving system is powered by a cable and winch, and a double truck assembly may be positioned on one or both sides of the railroad track. Railway car indexers including a low dog which engages the lower portion of the truck frame work fine if the railway car is loaded to provide downward acting forces on the truck frame to prevent derailing. However, low dog engaging members may tend to lift the truck frame from the railroad track if the railway car is empty.

While these earlier arrangements have provided generally satisfactory operation, there remains the need to simplify the system by reducing the necessary moving parts and exposed mechanisms to improve operation and reduce the need for maintenance. The elimination of sheaves and cables or chains from the operation of such a system would clearly present an advantage. In addition, a simplification of the mechanical complexity associated with the operation of the dogs, together with better automation of the raising and lowering of the dogs is definitely desirable as is a reduction of the parts exposed to the environment when the system is not in use.

SUMMARY OF THE INVENTION

The purpose of the present invention is to provide a rail car indexer that automatically moves a series of coupled rail cars with a continuous hand off or alternate transfer of the rail car bogeys between coordinated dogs. The operation including transfer from one dog to the next is accomplished without the drawback associated with dogs ramming into the rail car axles during motion by either the forward or rearward directions. The rail car indexer includes a pair of closely spaced, parallel, linearly offset progressors motivated between the rails each of which has a barney and dog attached thereto. The progressors are operated by fluid hydraulics and the operation is controlled by a programmable logic controller. Counter balance and back pressure bypass valves are connected in-line in the fluid hydraulic system to insure that the dogs remain in their lowered position until the proper progressor is ready to begin pulling on the rail car bogey axle. Sensors and a photo eye emitter and receiver coordinate the extension, retraction and transfer of an axle between the progressors.

OBJECTS

It is accordingly a principal object of the present invention to provide a fluid operated axle progression system for railroad cars which eliminates the need for interconnecting cables, sheaves, chains and other high maintenance devices.

Another object of the present invention is to provide an automatic, fluid operated, axle progression system wherein both the speed and stroke of progression is varied automatically.

A further object of the present invention is to provide an automatic, fluid operated, axle progression system wherein the speed of each progressor automatically varies independent of the speed of the other progressor.

Another object of the present invention is to provide a continuous transfer of truck axles between the forward and rearward progressors wherein the lengths of short and long transfers may vary over the entire chain of rail cars.

Still another object of the present invention is to improve automation with respect to coordinating the raising and lowering of the dogs in a manner which reduces the complexity of the dog-operating mechanism.

Yet another object of the present invention is to provide a fluid operated axle progression system which uses regeneration.

A still further object of the present invention is to provide a counter balance valve and back pressure by-pass valve in an automated system to control operation of the dogs.

These and other objects, as well as these and other features and advantages of the present invention will become readily apparent to those skilled in the art from a review of the following detailed description of the preferred embodiment in conjunction with the accompanying claims and drawings in which like numerals in the several views refer to corresponding parts.

DETAILED DESCRIPTION

Figure 1:
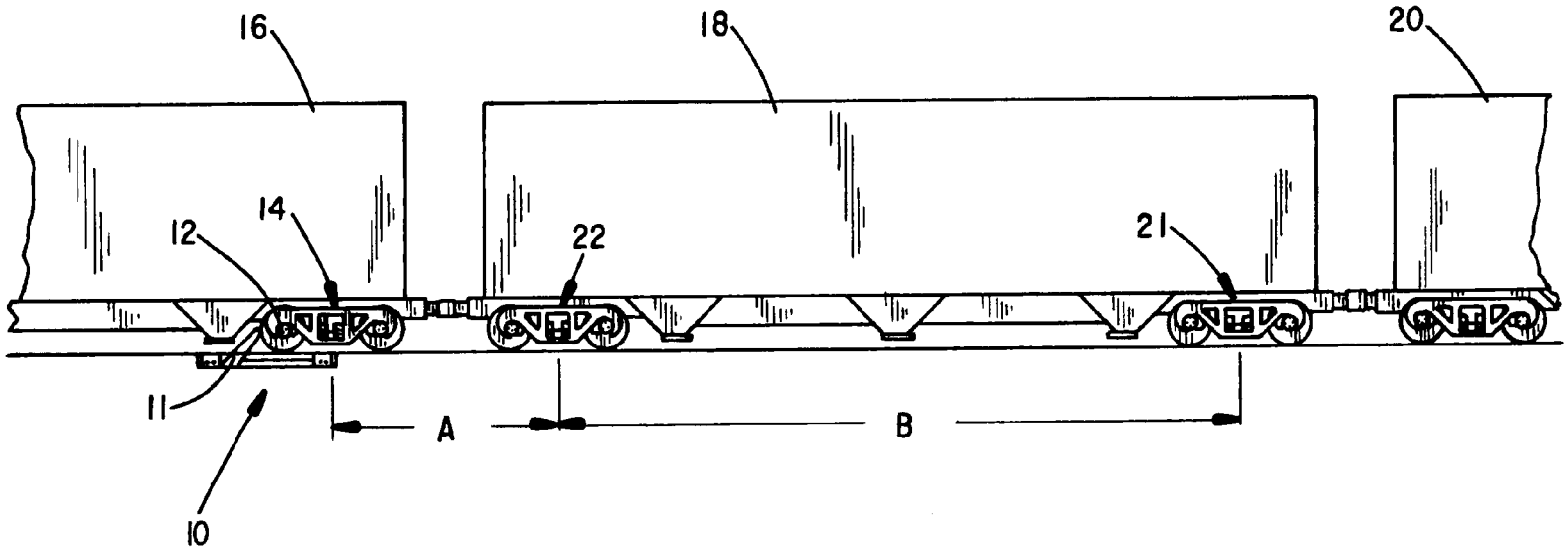
FIG. 1 is a fragmentary side elevational view partially in section of several rail cars connected as part of a trip of cars being progressed by a rail car indexer of the present invention.

Referring first to FIG. 1, there is shown generally at 10 portion of a rail car indexer in accordance with the present invention configured to advance the cars from left to right with respect to the drawing. A dog of a progressor of the rail car indexer 10 is shown aligned and engaging a rear axle 12 of a front bogey frame 14 (based on indexing direction) of a rail car 16 coupled in series to several other rail cars 18–20 which form part of a string or trip of cars to be sequentially progressed or indexed. The car 18 has front and rear bogey frames 21 and 22. For the purpose of this application and in conformity with general practice in the art, the distance "A" between the bogey frames 14, 22 of two adjacent cars will hereinafter be referred to as a "short transfer" distance and the distance "B" between the front and rear bogeys of a single car will hereinafter be referred to as a "long transfer" distance.

Figure 2:
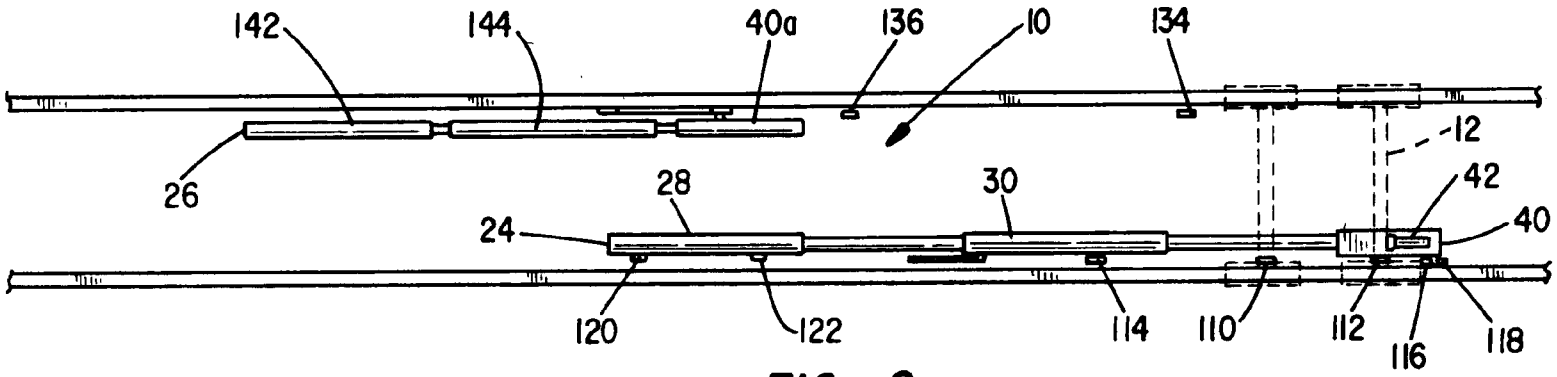
FIG. 2 is a fragmentary top plan view showing the forward progressor fully extended with dog raised and engaging an axle of the rail car and the rearward progressor shown fully retracted.
Figure 3:
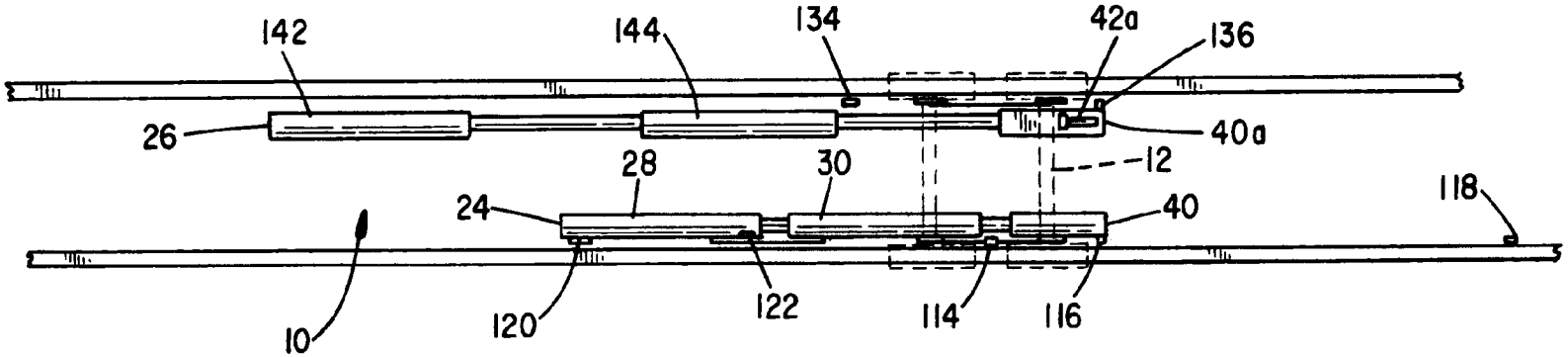
FIG. 3 is a fragmentary top plan view similar to FIG. 2 just after a hand off from the forward progressor to the rearward progressor showing the rearward progressor fully extended with its dog raised and engaging an axle of the rail car and the forward progressor fully retracted.
Figure 4:
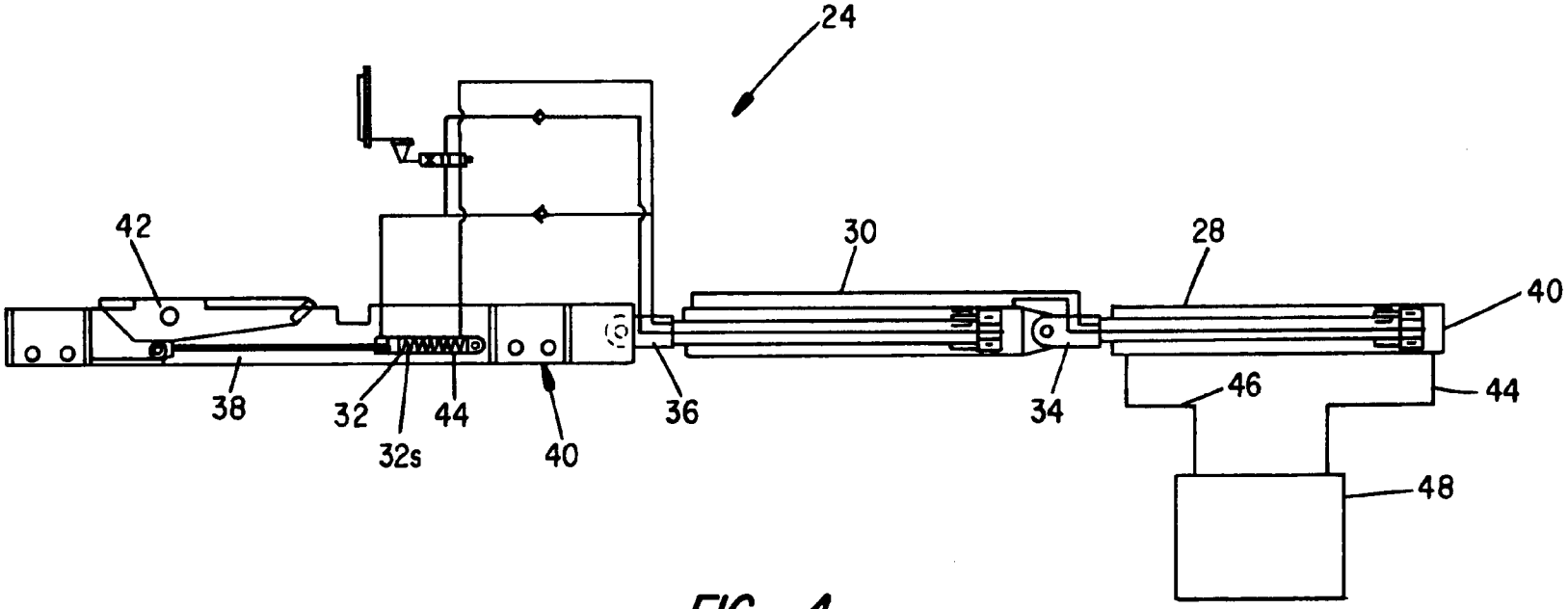
FIG. 4 is a simplified schematic side elevational view partially in section to illustrate one possible embodiment of the progressor of the rail car indexer of the present invention.

FIGS. 2 and 3 depict plan views of the general layout of the axle progressor of the invention in two positions. As seen in the Figures, the rail car indexer or progressor system 10 has a pair of staggered progressors including a forward progressor 24 and rearward progressor 26 mounted between the rails of a railroad track in spaced, parallel relation. Each progressor 24, 26 includes a respective double-acting stationary or trunnion cylinder 28, 142 in serial connection with a double-acting tandem or sliding cylinder 30, 144 which itself is serially connected to a barney or dog operating system 40, 40*a*.

As best seen in FIGS. 4–7, trunnion cylinder 28 has a rod 54 that is provided with a connection fitting 33 that is vertically pivotally connected to the blind end of sliding or tandem cylinder 30 as by clevis connector 34. The rod 84 of sliding or tandem cylinder 30 also carries a connection fitting 36 which, in turn, is attached to a frame 38 of barney 40. The barney 40 carries a dog 42 pivotally attached to the frame 34, wherein the dog 42 is normally held in a fully lowered or stowed position (cylinder extended) by a heavy compression spring 32*s*. The dog may be actuated to the raised and axle engaging position only when the single-acting, dog-actuating hydraulic cylinder 32 acts to overcome the spring and retract the cylinder 32. Hydraulic fluid lines as at 44 and 46 are divided into a plurality of segments to supply the cylinders 28, 30 and 32 of the forward progressor 24 with hydraulic fluid in conjunction with a hydraulic power unit generally 48, as will be explained.

Figure 5:
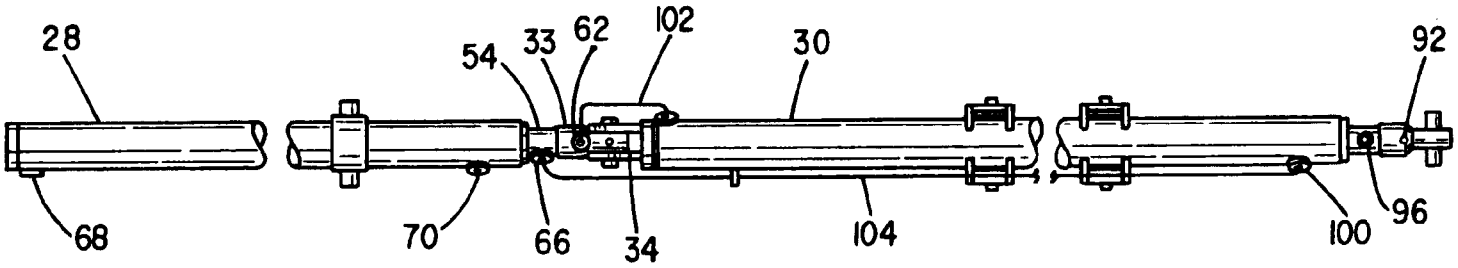
FIG. 5 is an enlarged schematic view with parts broken away of trunnion and sliding cylinders showing the external mechanical and hydraulic connections.
Figure 6:
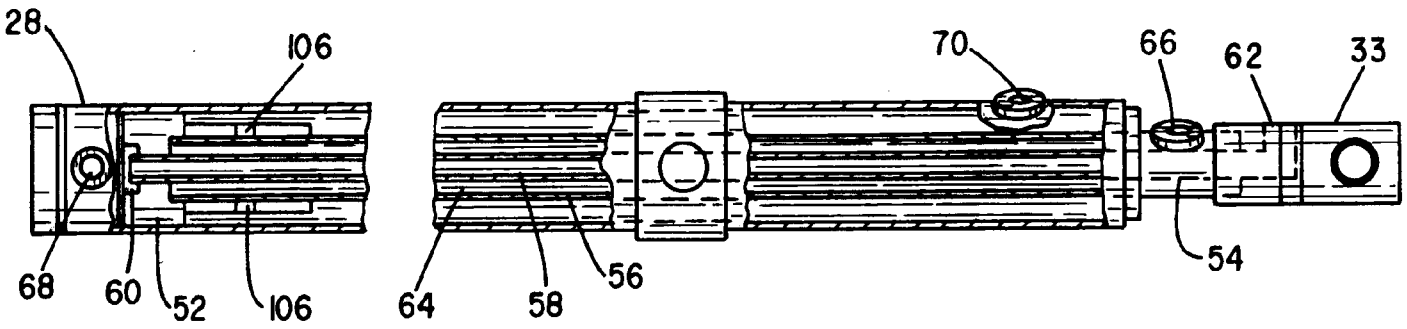
FIG. 6 is an enlarged view of a trunnion cylinder as in FIG. 5 with parts broken away illustrating the internal passage configuration.
Figure 7:
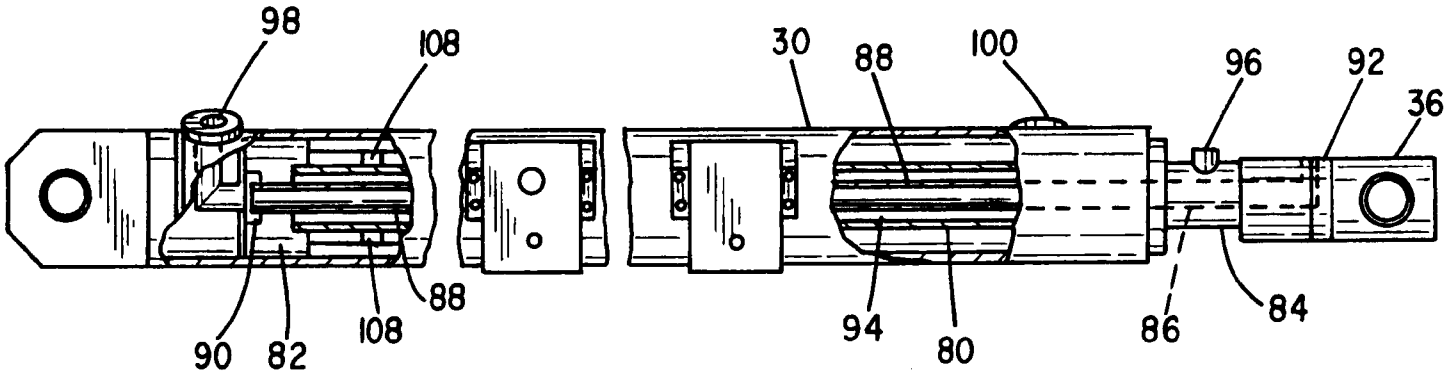
FIG. 7 is a view similar to FIG. 6 illustrating the internal passage configuration of a sliding cylinder.

The fluid connections linking the stationary cylinder 28, the sliding or tandem cylinder 30 and the foremost dog actuating cylinder 32, together with the internal construction of the trunnion and sliding cylinders 28 and 30 are best pictured in FIGS. 5–7. Each trunnion cylinder 28 has a hollow internal bore 50 carrying a piston 52 connected to a uniquely constructed hollow cylinder rod 54. Rod 54 is provided with a longitudinal central bore 56 which contains a central hydraulic tube 58. The tube 58 which is smaller than the bore 56 extends into a bore in the piston 52 which connects with the blind end of the hollow cylinder bore 50 through a recessed opening 60 and communicates with the blind end extend port 68. At the rod end, the tube 58 extends into connection fitting 33 where it connects with a rod eye extend port at 62. The oversized central bore 56 and central tube 58 of the rod 54 further define an annular chamber 64 surrounding the central tube 58 which is provided with an external connection in the form of a rod retract port 66. The central tube 58 is held in place in the central bore 56 of the rod by an open webbing (not shown). The trunnion cylinder 28 is further provided with a retract port 70 in addition to blind end extend port 68.

As shown in FIG. 7, a similar internal construction is used for tandem or sliding cylinder 30 in which central internal bore 80 carries piston 82 and cylinder rod 84 itself having a central bore 86 containing a central tube 88 and defining therewith an annular chamber 94. The tube 88 extends into piston 82 at the blind end and communicates with the blind end extend port 98 through opening 90. Tube 88 extends into connection fitting 36 at the rod end of cylinder 30 where it connects to one access port to the dog control system at 92. The tandem cylinder 30, as with the trunnion cylinder 28 is further provided with a rod retract port 96, also connected to the dog control system along with blind end extend port 98 and a cylinder retract port 100. As will be described in greater detail below, the hydraulic system includes several controls that vary the flow and pressure of the hydraulic fluid to the cylinders 28, 30 and 32. The consecutive central tubes 58, 88 of cylinders 28 and 30 are serially connected by an external high pressure hydraulic hose 102 and the annular chambers 64, 94 of cylinders 28 and 30 are connected via ports 66 and 96 by an external high pressure hydraulic hose 102. The annular chamber 64 of cylinder 28 is further connected to bore 80 of cylinder 30 at 100. The annular chambers 64, 94 communicate with respective cylinder bores 50 and 80 through a series of blind end ports 106 and 108 respectively. In this manner, the rod annular chambers are pressurized with the main cylinder bores on the power or pull stroke. While FIGS. 4–7 show and the foregoing description addresses the components of the forward progressor 24, such equally apply to the rearward progressor 26 as the two are substantially identical in construction.

FIGS. 2 and 3 further depict plan views of a progressing and hand-off sequence of the bogey truck or carriage. The progression system of the invention is designed to sequentially index or spot a trip of 30 or more cars. FIG. 2 shows the forward progressor 24 fully extended. A pair of spaced, normally closed, tripper pedal-operated actuating dog valves 110, 112 are provided that are opened by engagement of corresponding tripper pedals by both the flanges of corresponding wheels on one side of a bogey carriage 14. The tripper pedals may be of suitable construction and aligned near the rail such that the flange of the wheel forces the pedal downward thereby actuating the corresponding dog valve 110, 112. The forward progressor 24 also includes sequential serially spaced apart respective extension and retraction proximity switches 114, 116 that, when actuated, transmit a signal to a programmable logic controller, the signal being indicative of near full extension and retraction respectively of the progressor. The forward proximity switch 116 (PX-1L) is shown actuated closed by the presence of the free end of the forward barney 40. A photo eye emitter 118 and corresponding receiver 120 are positioned between the tripper pedal and the stationary cylinder 28.

FIG. 3 shows the rearward progressor 26 fully extended with a corresponding pair of normally closed tripper pedal-operated dog actuating valves 130, 132 opened by engagement of the flanges of corresponding wheels on the other side of bogey 14. Similar to the forward progressor 24, the rearward progressor 26 includes a pair of spaced apart respective extension and retraction proximity switches 134, 136 that, when actuated, transmit signals to a programmable logic controller, the signals being indicative of near full extension and retraction, respectively. The forward proximity switch 136 is shown actuated closed by the presence of the free end of rearward barney 40*a*. The rearward progressor 26 also includes rearward dog 42*a* pivotally attached to barney 40*a*, a dog actuating cylinder 138 with bias spring 140 (see FIG. 8) a trunnion cylinder 142 and a tandem cylinder 144.

The combined maximum stroke of the forward and rearward progressors (overall stroke) is designed to be sufficient to span the long transfer distances of rail cars of interest in an installation. This is normally about 55 feet.

Figure 8:
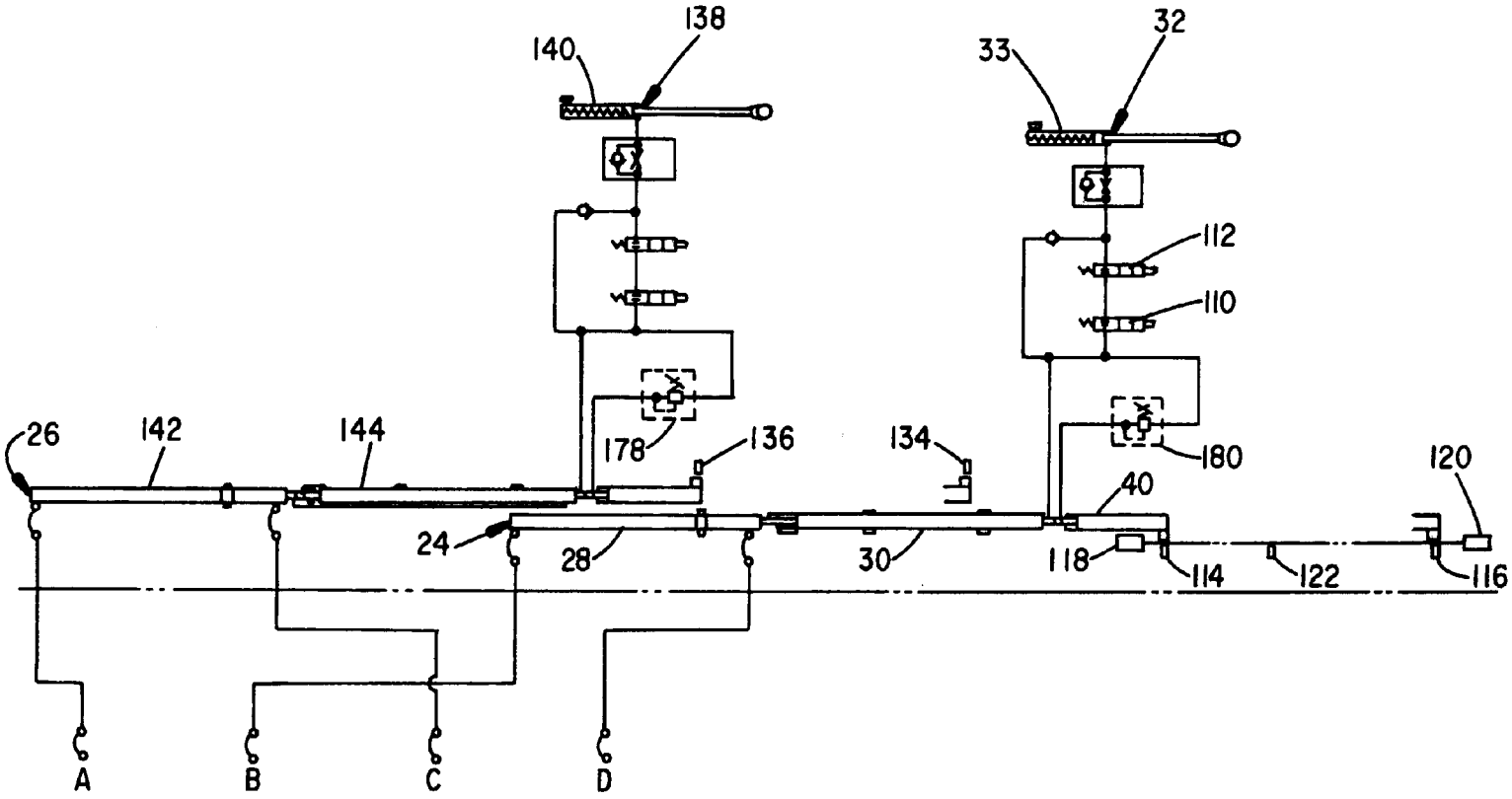
FIGS. 8 and 9 show a schematic diagram of a preferred basic hydraulic operating system used to operate the hydraulic cylinders of the rail car indexer of the present invention.
Figure 9:
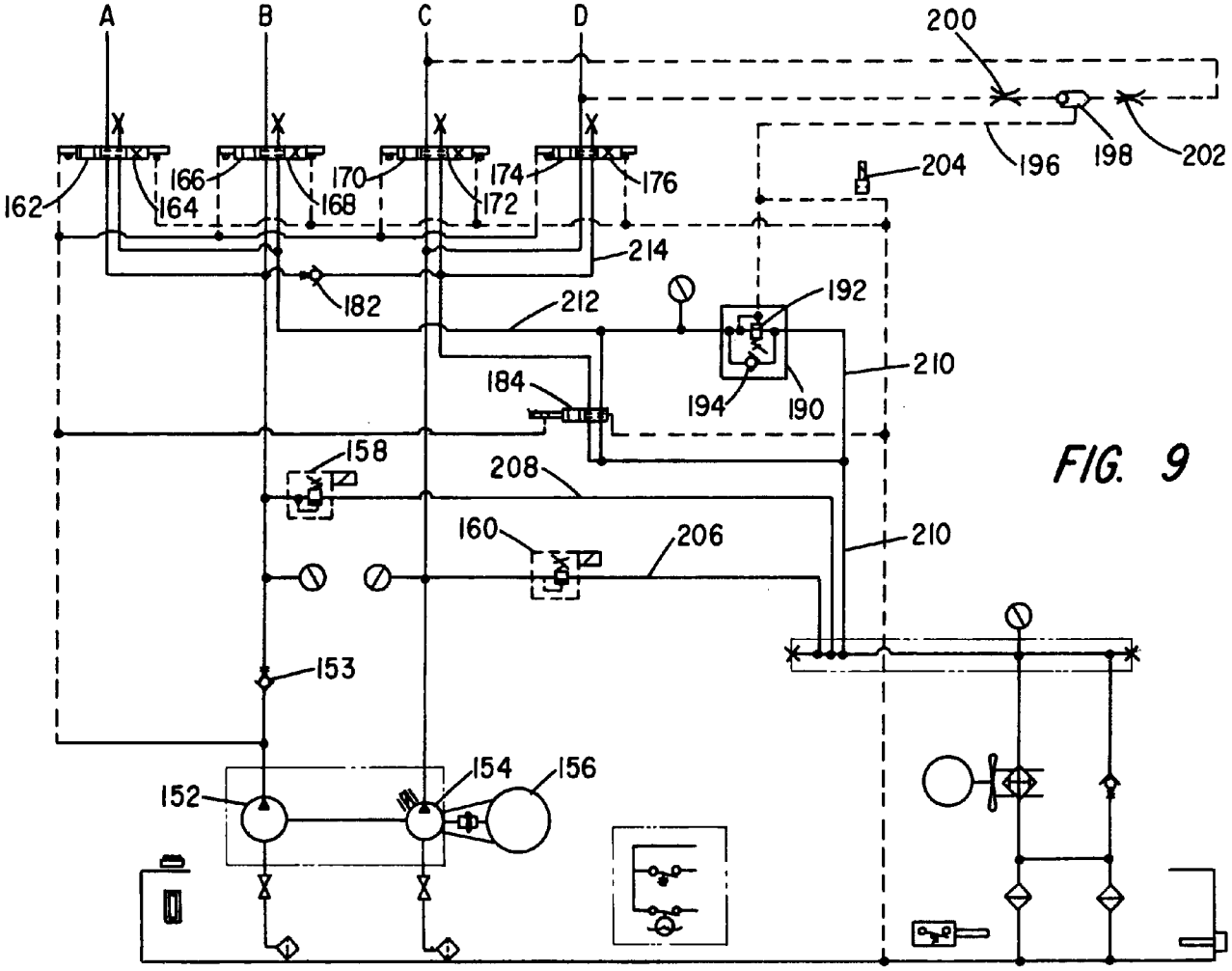

FIGS. 8 and 9 together show the hydraulic schematic for the indexing system, including valves and switching devices used to control and coordinate the actuation of the forward and rearward progressors 24 and 26. Connectors A, B, C, and D in FIG. 8 correspond to the like designated lines of FIG. 9 and interconnect the hydraulic lines of the diagram shown in FIG. 9 with the stationary cylinders 28 and 142 shown in FIG. 8. As can be seen from the drawings, lines A and C are used to operate the corresponding rearward or right progressor 26 and lines B and D to operate forward or left progressor 24.

The hydraulic system, generally 150, includes an extend or retrieve pump 152 which may be a constant volume gear pump, with output check valve 153, and a variable volume retract or pull pump 154, both suitably powered by electric motors as at 156. A suitable fluid reservoir or sump (not shown) is also provided. The system further includes an extend or retrieve pressure relief valve 158, and pull pressure relief valve 160. Each of the lines A, B, C, D is provided with a respective electrically operated multi-position flow control valve that includes dual solenoid valves. Thus, line A has extend and retract positioning directional control solenoid valves 162, 164, respectively; line B, directional extend and retract control solenoid valves 166, 168; line C has valves 170, 172 and line D has valves 174, 176. Relief valves are also provided in association with the operation of the dogs at 178 and 180.

The system further includes a regeneration aspect which will be explained and which includes regeneration check valve 182, regeneration and back pressure bypass valve 184. In addition, a unique counter-balance system is provided that includes a counter-balance valve 190 having a pilot port 192 and check valve 194. The pilot valve is connected via a line 196 with a shuttle OR valve 198, with associated orifices 200 and 202. A dog bleed valve is provided at 204. Return lines to sump are shown at 206, 208 and 210.

An aspect of the present invention involves the unique system for controlling the dogs. The system is designed, as will be recognized from the FIGS. 8 and 9, so that a dog cannot raise when the corresponding progressor is extending (retrieving), but only during retraction (pulling). The maximum setting for the retrieve relief valve 158 is designed to be below the minimum pressure required to overcome the bias spring 33, 140 of each respective dog cylinder 32, 138. Thus, even if the flange operated valves 110, 112 or 130, 132 open due to the presence of a set of bogey wheels in the extend mode, the fluid pressure is insufficient to overcome the corresponding bias spring. For example, the design setting used in the detailed embodiment is normally 750 psi for the retrieve relief valve 158 and 1000 psi to overcome the dog bias spring.

In the retract or pull mode, the counter balance valve 190 works in combination with the shuttle OR valve 198 to maintain the pressure available to the dogs at at least 1000 psi using the 3:1 ratio at the pilot valve 192 of the counter-balance valve 190 and the counter-balance valve set at 3000 psi. As can be seen from the diagram, with the corresponding flow control valve in the retract position as either progressor 24 or 26 is retracted, oil leaves via the common blind end port of the trunnion cylinder and proceed through the appropriate solenoid 168, 164 into line 212 from which it can only return to the tank or sump through counter-balance valve 190 which, in turn, requires that the system be at 1000 psi to open. This assures that the system pressure will be adequate to raise the dogs should the respective wheel trippers on the dog carriage of interest be activated by a rail car wheel.

Figure 10:
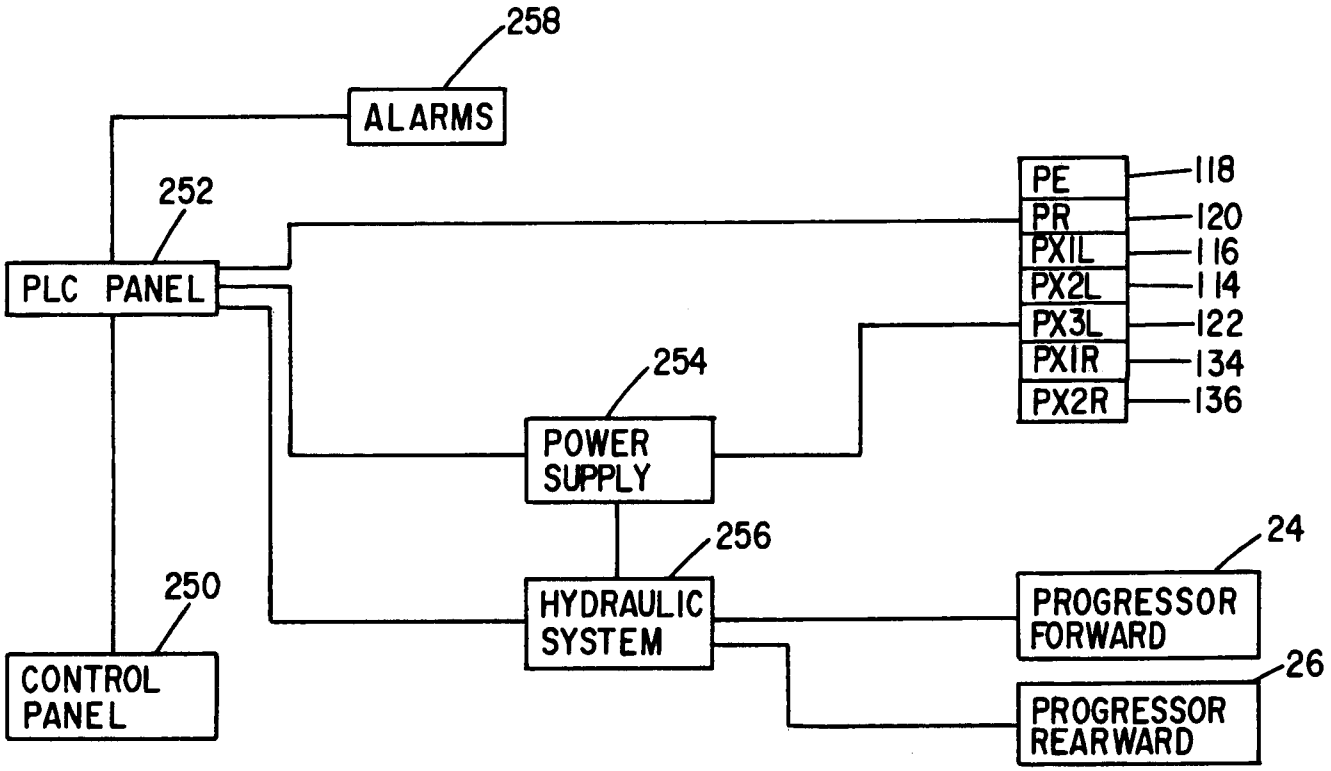
FIG. 10 is a block diagram generally showing the controls used to control the rail car indexer of the present invention.

FIG. 10 shows generally in schematic form the controls for the forward (left) and rearward (right) progressors 24 and 26. A control panel 250 includes the several pushbuttons and/or other switches that are operated by the user. The control panel 250 is electrically coupled to a Programmable Logic Controller (PLC) 252 which includes a central processing unit (CPU) and all necessary corresponding integrated circuits. The PLC receives and processes signals from proximity switches 114, 116, 122, photo eye emitter and receiver 118–120 and proximity switches 134–136. These devices and the PLC 252 are electrically powered by a suitably fused power supply 254. The hydraulic system box 256 includes the pumps, electrical components including solenoids, the position of which provide an indication to the PLC the status of each cylinder, and sensors which indicate the pressure within each corresponding fluid line and the status of each relief valve or other flow control component suitable alarms indicated by 258. Alarms 258 are electrically coupled to the PLC 252 and are activated by the PLC 252 depending upon the status of the progressors 24 and 26.

Having described the constructional features of the present invention, by way of a detailed example but without any limitation intended, the preferred mode of operation will next be presented. At the beginning of a progression cycle for a given trip of cars or when the indexing system of the invention is to started up at the beginning of a work day, all of the cylinders are designed to be in the retracted state. When the progressor is in this position, the dogs are locked down. This retracted, locked down position is provided to protect the cylinder rods from damage as they will not be exposed and to make it safe to move cars over the progressor system in any manner desired. To begin operation, the operator must start the hydraulic power unit and after an alarm circuit has timed out, with the hydraulic power unit running, the operator can extend and exercise both the rearward or left and the forward or right progressors in the normal sequence without the presence of any railroad cars. This circulates and warms the oil and insures that the operation of both the cylinders and the dogs will be smooth when an actual trip of cars is being advanced. After this has been accomplished, the system is ready to address an actual trip or string of cars.

The operation of one progressor of the system will first be described with reference to FIGS. 8 and 9. As can be seen from the schematic diagram, the operation of the other is identical. To extend the forward progressor, relief valve 158 and solenoids 166 and 176 are energized. In this manner, oil is pumped out of the gear pump 152 through the pilot check valve 153 through the directional control valve and into the blind end of cylinder 28 along line "B" and the cylinder begins to extend. While cylinder 28 is extending, oil also travels into the blind end of cylinder 30 via tube 58 through the inside of cylinder 28 and connection line 102 (FIG. 5). This oil, in turn, travels to relief valve 180 but both valves 110 and 112 are closed and the pressure is, in any event, insufficient to operate the dog cylinder 32 so that the oil will stop at this point. The rod ends of cylinders 28 and 30 are also connected to each other via line 104 (FIG. 5) and internal tubing in the cylinders (see FIGS. 6 and 7). In this manner, hydraulic fluid displaced from the rod ends of the cylinders by the movement of the pistons along the cylinders is collectively expelled from the rod end of cylinder 28 via conduit "D". This hydraulic fluid returns via solenoid valve 176 and line 214 through check valve 182 where it combines with oil being pumped from pump 152 to accomplish regeneration. In no event does the pressure in the system during extension exceed the setting of relief valve 158 which is below the minimum required to raise the dogs.

The retraction of the forward or pull cylinder with the dogs active requires energizing dog or pull relief valve 160 and flow control solenoids 168 and 174. Hydraulic fluid from the piston pump 154 is conducted through the valve at 174 along line "D" and into the rod end of cylinder 28 at 70. Part of the oil splits off and travels through the orifice 200 and the shuttle valve 198 to 3:1 pilot port 192 of counter-balance valve 190. The oil traveling into the rod end of cylinder 28 also via interconnections mentioned above enters the rod end of cylinder 30 and the cylinders begin to retract. This oil also travels to rail tripper-operated valve 110 awaiting the operation of the wheel tripper going under a rail car wheel. Of course, the blind ends of cylinders 30 and 28 are connected by external connection 102 (FIG. 5) and by the internal passages previously explained such that the oil expelled in retracting the cylinders exits via conduit "B" through valve 168 and line 212 to counter-balance valve 190 where the pressure will build until it reaches 1000 psi which is required with the 3:1 pilot port to operate the counter-balance valve 190, which when open, allows the returning oil to be passed to the tank or sump via line 210. Since the pressure is maintained in a minimum of 1000 psi, if both wheels trippers are activated at the same time, valves 110 and 112 will open and oil will be allowed to the rod end port of the dog cylinder 32 thereby raising the dog.

Initially, a locomotive is used to position or spot a string or trip of cars within range of a stowed (locked down) forward progressor as at 24. Once the cars are in range, progression of the rail cars may be accomplished automatically with the forward and rearward progressors 24 and 26.

To begin movement of the string of cars, the operator closes a switch on the control panel 90 which is designated as a "move cars" switch. After a preset time delay with appropriate audible warning or alarm, the forward progressor 24 begins retracting. An interlock system is provided that inhibits initial movement of the forward progressor 24 if a wheel of the car is located so as to actuate closed one or both of the tripper-operated valves 110, 112. When the tripper-operated valves 110, 112 are depressed by a wheel, the beam from the photo eye emitter 118 is also interrupted or broken, indicating or verifying that the tripper-operated valves 110, 112 are held opened. This is part of an interlock system that avoids raising of the forward dog 38 when the first car in the string of cars has not been positioned in the proper range of the forward trunnion cylinder 28 and prevents a dog from raising between the axles of a common bogey frame which could cause damage to the car.

Assuming proper car positioning, once the forward progressor 24 begins retracting slowly, the forward barney 40 is pulled under the forward or first encountered set of wheels of the first car in the string of cars. When the wheels are aligned above the tripper pedals and the valves 110 and 112 are both actuated open, the forward dog 42 is caused to raise and it engages the second encountered or rear axle of the forward bogey carriage. The speed of retraction is preferably programmed to be increased automatically once the axle is engaged, but of course, it may alternatively be increased or decreased manually. This is accomplished by varying the variable volume output of pull pump 154, which may be 0–45 gpm or the like. Maximum speed is normally about 50 fpm at 45 gpm. The retraction of forward progressor 24 continues until the rearmost proximity switch 114 is actuated closed. Thereafter, the retraction of forward progressor 24 slows until cylinders 28 and 30 are fully retracted.

When the cylinders 28 and 30 are fully retracted, the rearward progressor begins retracting. When the wheels of the forward bogey actuate the tripper pedals and close the rearward tripper valves 130 and 132, the rearward dog 42*a* raises and engages the rear axle of the forward bogey. The rearward progressor 26 then retracts pulling the train towards the rearward stationary cylinder 142. As the rearward progressor retracts, the car is "handed-off" and the forward dog 38 lowers and the forward progressor 24 begins to extend. The speed of retraction of the rearward progressor may then be increased either manually or automatically. During the retraction of the rearward progressor 26, the photo eye emitter 118 is active. When the beam is broken twice by the rail car wheels actuating the corresponding tripper pedal, the speed of rearward progressor 26 is decreased.

The forward progressor 24 then begins retracting slowly until both tripper pedals are actuated by the bogey wheels. The forward dog 38 then rises and the pulling of the rail car is transferred to the forward progressor. As the forward progressor 24 continues to retract, the rearward progressor 26 "looks" for the next bogey to grab and pull. This pull and handoff arrangement continues as needed until all of the rail cars have been pulled past the progressors 24 and 26. The operator may stop the progressor at any time so that a car may be processed, and the progressors 24 and 26 will continue the progression once they are re-activated.

Once the last car of a trip or string has been pulled through, an automatic dog lock-down system is provided so that the operator can lock down the dogs after a sufficient time delay and appropriate alarm. Dog lock down is accomplished by first extending the forward progressor to make room for the dog to drop if it is presently against an axel. Once this is accomplished, the forward progressor will retract its full stroke with its dog down. In this sequence, the counterbalance valve is by-passed and oil flows through by-pass valve 184 directly to the sump so that pressure cannot reach the 1000 psi necessary to raise a dog. When the carriage reaches the full stroke, it will continue to retract for a preset amount to insure that it is fully retracted. Once this is complete, the rearward progressor will go through the same procedure. When this is finished, the dog lock-down cycle is complete. Movement will stop and a panel indication will show that the dogs are safely locked down so that cars may be again moved over the system as desired.

This invention has been described herein in considerable detail in order to comply with the patent statutes and to provide those skilled in the art with information needed to apply the novel principles and to construct and use such specialized components as are required. However, it is to be understood that the invention could be carried out by specifically different equipment and devices, and that various modifications, both as to the equipment details and operating procedures, can be accomplished without departing from the scope of the invention itself.

What is claimed is:

1. An apparatus for shifting a line of railroad cars comprising:

(a) first and second staggered parallel fluid operated linear primary actuators, said primary actuators comprising a plurality of serially connected simultaneously operated double acting fluid cylinders which extend and retract together and each said primary actuator further comprising a stationary and one or more tandem cylinders including an end tandem cylinder bearing a free end and a fluid supply and return line connected to each of said primary actuators;

(b) first and second pivotally mounted axle addressing dogs carried by said first and second primary linear actuators and connected to the free ends of the end tandem cylinders;

(c) first and second fluid operated linear dog pivoting actuators for respectively moving said first and second axle addressing dogs between a lowered stowed position and a raised axle addressing position;

(d) a fluid operating system connected to operate said linear primary actuators and said dog pivoting actuators;

(e) first and second sensing means carried respectively by a moving cylinder of said first and second primary linear actuators for sensing the presence of consecutive wheels of a railroad car bogey carriage;

(f) control means responsive to said first and second sensing means for controlling the operation of first and second primary linear actuators and said first and second dog pivoting actuators; and (g) wherein said control means further includes means for preventing the raising of a dog during extension of a primary actuator and means for maintaining a dog in the raised position during retraction.

2. The apparatus of claim 1 wherein said means for preventing the raising of the dog during extension of a primary actuator further comprises a relief valve in the fluid supply and a biasing spring in said dog pivoting actuator resisting raising of the dog, said relief valve being set below a force needed to raise said dog.

3. The apparatus of claim 1 wherein said means for retaining said dog in the raised position during retraction includes a counter-balance drain valve having a pilot operating port in said fluid return line which maintains system back pressure above that required to raise said dogs.

4. The apparatus of claim 3 wherein said counter-balance drain valve is pilot operated and wherein said pilot port is connected to lines connected to sense pressure of both supply and return fluid.

5. The apparatus of claim 4 wherein a respective fluid line is connected to said pilot port via a shuttle OR valve.

6. The apparatus of claim 1 wherein said first and second primary actuators extend when in a return mode.

7. The apparatus of claim 4 wherein said first and second primary actuators extend when in a return mode.

8. The apparatus of claim 1 wherein said stationary and tandem cylinders comprise hollow rods including multiple concentric rod lumens comprising an inner and an outer rod lumen, said inner rod lumen being defined by a tubular member carried centrally in said outer lumen.

9. The apparatus of claim 8 wherein said inner lumens of rods of consecutive cylinders are connected together and between a blind end of the stationary cylinder and the dog pivoting actuator and wherein said outer rod lumens are connected to rod ends of said cylinders which are, in turn, connected together.

10. The apparatus of claim 1 wherein each primary actuator includes one tandem cylinder.

11. The apparatus of claim 1 further comprising regeneration means for adding return fluid to supply fluid when either of said primary actuators is extended.

12. The apparatus of claim 11 wherein said regeneration means further comprises a check valve in said return line between said return line and said supply line.

* * * * *